US008284229B2

(12) United States Patent
Aviel et al.

(10) Patent No.: US 8,284,229 B2
(45) Date of Patent: Oct. 9, 2012

(54) IMAGING HEAD FOR 3D IMAGING

(75) Inventors: David Aviel, Tel Mond (IL); Ophir Eyal, Ramat Ha-Sharon (IL)

(73) Assignee: Eastman Kodak Company, Rochester, NY (US)

( * ) Notice: Subject to any disclaimer, the term of this patent is extended or adjusted under 35 U.S.C. 154(b) by 468 days.

(21) Appl. No.: 12/555,003

(22) Filed: Sep. 8, 2009

(65) Prior Publication Data

US 2011/0058010 A1 Mar. 10, 2011

(51) Int. Cl.
*B41J 2/45* (2006.01)

(52) U.S. Cl. ..... 347/238

(58) Field of Classification Search ..... 347/229, 347/233–235, 238, 241, 242, 144, 248–250, 347/256–258, 230, 244
See application file for complete search history.

(56) References Cited

U.S. PATENT DOCUMENTS

| | | | | |
|---|---|---|---|---|
| 4,376,282 | A * | 3/1983 | Kotani et al. | 347/244 |
| 6,150,629 | A | 11/2000 | Sievers | |
| 2002/0195012 | A1 | 12/2002 | Juffinger et al. | |
| 2008/0018943 | A1 | 1/2008 | Eyal et al. | |
| 2008/0153038 | A1 | 6/2008 | Siman-Tov et al. | |
| 2008/0225108 | A1 * | 9/2008 | Koizumi et al. | 347/244 |

FOREIGN PATENT DOCUMENTS

| | | | |
|---|---|---|---|
| EP | 2 098 366 | A2 | 9/2009 |
| WO | WO 2007/149208 | A2 | 12/2007 |
| WO | WO 2009/029167 | A1 | 3/2009 |

* cited by examiner

*Primary Examiner* — Hai C Pham
(74) *Attorney, Agent, or Firm* — Nelson Adrian Blish

(57) ABSTRACT

An imaging head (404) for writing an image on a substrate (108) includes an array of emitters (104) comprised of groups of emitters (120, 116, 112); imaging lens (408) that focuses light from each group onto the substrate; and wherein light from each group is focused at a different depth relative to a surface of the substrate.

10 Claims, 5 Drawing Sheets

IMAGING HEAD FOR 3D IMAGING

CROSS REFERENCE TO RELATED APPLICATIONS

Reference is made to commonly-assigned co-pending U.S. patent application Ser. No. 11/615,025, filed Dec. 22, 2006, now U.S. Publication No. 2008/0153038, entitled HYBRID OPTICAL HEAD FOR DIRECT ENGRAVING OF FLEXOGRAPHIC PRINTING PLATES, by Siman-Tov et al.; and U.S. patent application Ser. No. 11/424,919, filed Jun. 19, 2006, now U.S. Publication No. 2008/0018943, entitled DIRECT ENGRAVING OF FLEXOGRAPHIC PRINTING PLATES, by Eyal et al.; the disclosures of which are incorporated herein.

FIELD OF THE INVENTION

The present invention relates to 3D imaging of a flexographic plate by using multiple emitters. The multiple emitters are configured to engrave on the same region of the flexographic plate during different time periods.

BACKGROUND OF THE INVENTION

Prior to setting forth the background of the invention in detail, it may be helpful to set forth definitions of certain terms that will be used hereinafter. The term computer-to-plate (CTP) as used herein relates to an imaging technology used in modern printing processes. In this technology, an image created in a desktop publishing application is output directly to a printing plate. CTP as used hereinafter relates also to the imaging device carrying out the process of outputting the computer-stored image to printing plates.

There are different types of printing plates used by CTP imaging devices. Most plates require post processing steps to produce two or three-dimensional features. The present invention refers to the type of plate known as flexographic printing plates. More specifically it refers to a CTP imaging device that is used for direct engraving of a flexography plates utilizing a light source configured from multiple emitters.

Direct engraving of a flexography plates means three-dimensional (3D) carving on the plate material by applied light source energy such as a laser. The concept of direct engraving is remarkably different from two-dimensional imaging techniques which require post processing steps in order to produce three-dimensional features on a plate to be applicable for the flexography market.

FIG. 1 shows a prior art CTP machine for direct engraving of a flexographic plate; multiple emitters array 104 is aligned parallel to the flexographic plate surface 108. The flexographic plate is attached to a rotating drum. For simplicity of the discussion the array of multiple emitters 104 comprises nine emitters. The array of multiple emitters 104 is composed from three groups of emitters 112, 116, and 120, each containing three emitters.

Group 112 emits light 136 on plate surface 108 during first drum revolution 124, group 116 emits light 140 during the second drum revolution 128, and group 120 emits light 144 during the third drum revolution 132. Each of the three groups 112, 116, and 120 in the previous example emit light on the same region of plate surface 108, i.e. pixels p1, p2, and p3 of pixels array 160 are affected by the three groups.

Additionally, during the second drum revolution 128 the first group of emitters 112 emits light 148 on pixels p4-p6. During the third drum revolution 132 pixels p4-p6 are affected by the second group of emitters 116 emitting light 152, while the first group of emitters 112 emit light 156 on pixels p7-p9. The emitters described by the prior art are all imaged just on the surface plane of the flexographic printing plate.

The present invention propose new embodiments concepts for CTP machines, wherein a light source, configured from multiple emitters, is adjusted in a slant or stair configuration relative to the surface plane of the flexographic plate. The slant or stair configuration enables simultaneously imaging different emitters on both the surface plane and at various depths within the printing plate. The multiple emitters are then activated in a way that enhances the direct engraving and ablating effect.

SUMMARY OF THE INVENTION

Briefly, according to one aspect of the present invention an imaging head writes an image on a substrate. The head includes an array of emitters comprised of groups of emitters; imaging lens that focuses light from each group onto the substrate; and wherein light from each group is focused at a different depth relative to a surface of the substrate.

The invention and its objects and advantages will become more apparent in the detailed description of the preferred embodiment presented below.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings wherein.

DETAILED DESCRIPTION OF THE INVENTION

In the following detailed description, numerous specific details are set forth in order to provide a thorough understanding of the disclosure. However, it will be understood by those skilled in the art that the teachings of the present disclosure may be practiced without these specific details. In other instances, well-known methods, procedures, components and circuits have not been described in detail so as not to obscure the teachings of the present disclosure.

Figure 4:
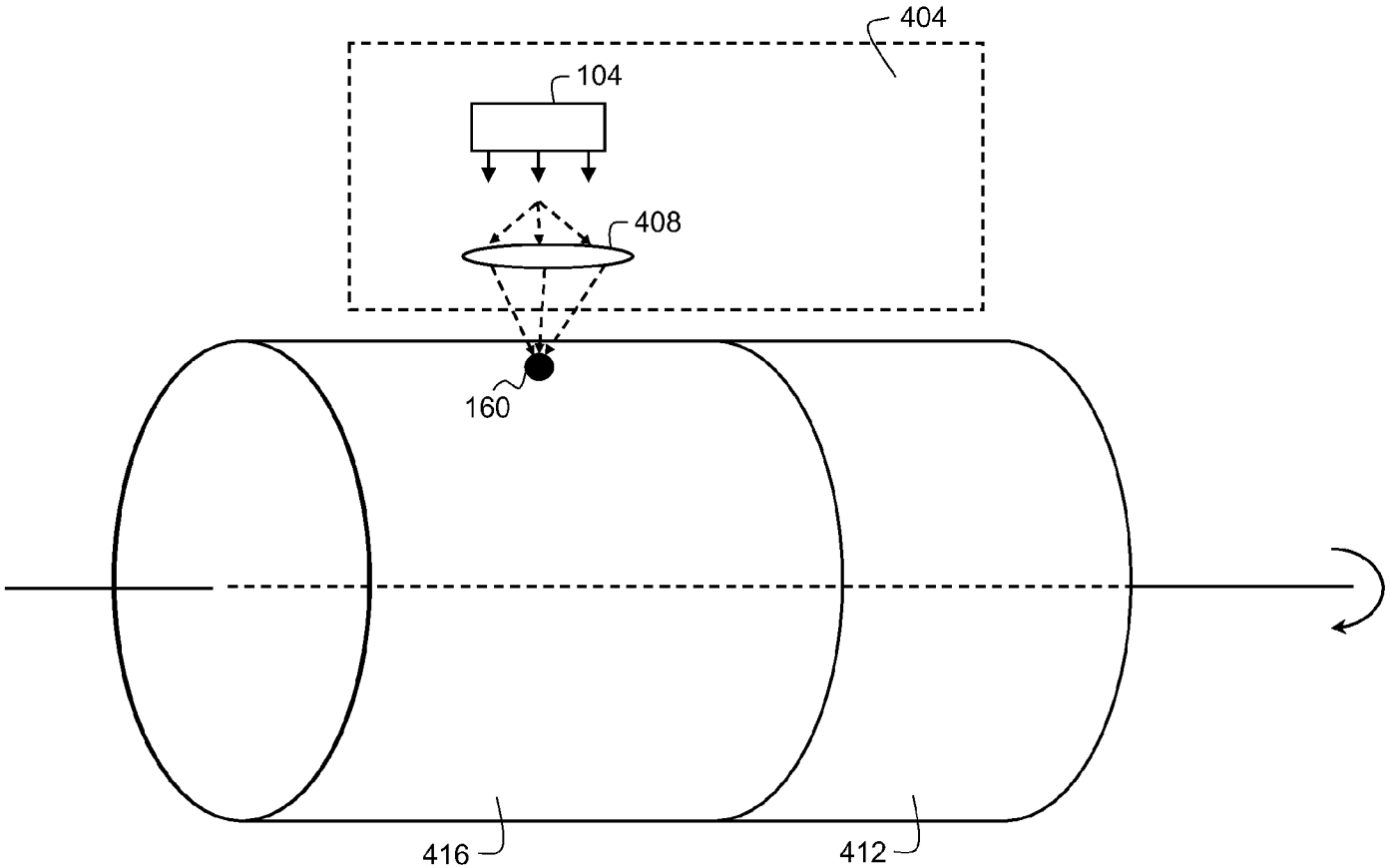
FIG. 4 is a schematic illustration of an emitter array as part of an imaging head configured to image a printing plate, mounted on a rotating drum.

FIG. 4 describes the general concept of a CTP printing machine that uses an array of multiple emitters.

Multiple emitters array 104 is shown as part of an imaging head 404, which includes at least the array of multiple emitters 104 and an imaging lens 408 such as a telecentric lens. The array of emitters emits light, which is focused by the imaging lens 408 on pixels 160 of printing plate 416. The printing plate 416 is wrapped around, the imaging drum 412, and is imaged by imaging head 404 as the drum rotates.

Figure 1:
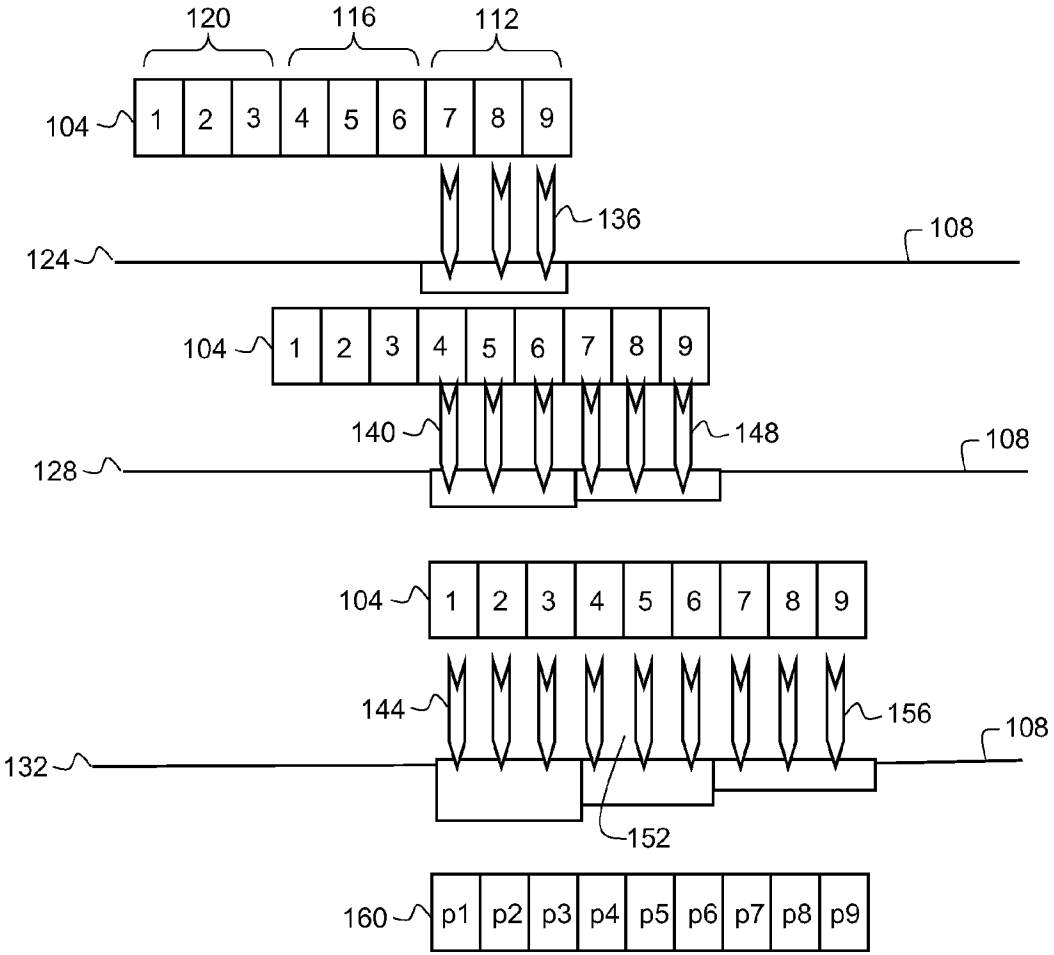
FIG. 1 (PRIOR ART)
FIG. 1 is schematic illustration of a prior art emitter array configured in parallel with respect to a plate imaging system.

The configuration in FIG. 1 shows multiple emitters array 104 positioned substantially in parallel to the plate surface 108, or perpendicular to the optical axis, created for example by emitted light 136. The array of emitters may include fiber coupled emitters or may be constructed from fiber lasers. Due to this geometric configuration, emitted light e.g. 136, 140, and 144 is applied on pixels p1-p3 at different drum revolutions, and is focused on the same focal plane. This results in a marginal incremental engraving on the surface of plate 108, between subsequent drum revolutions.

Figure 2:
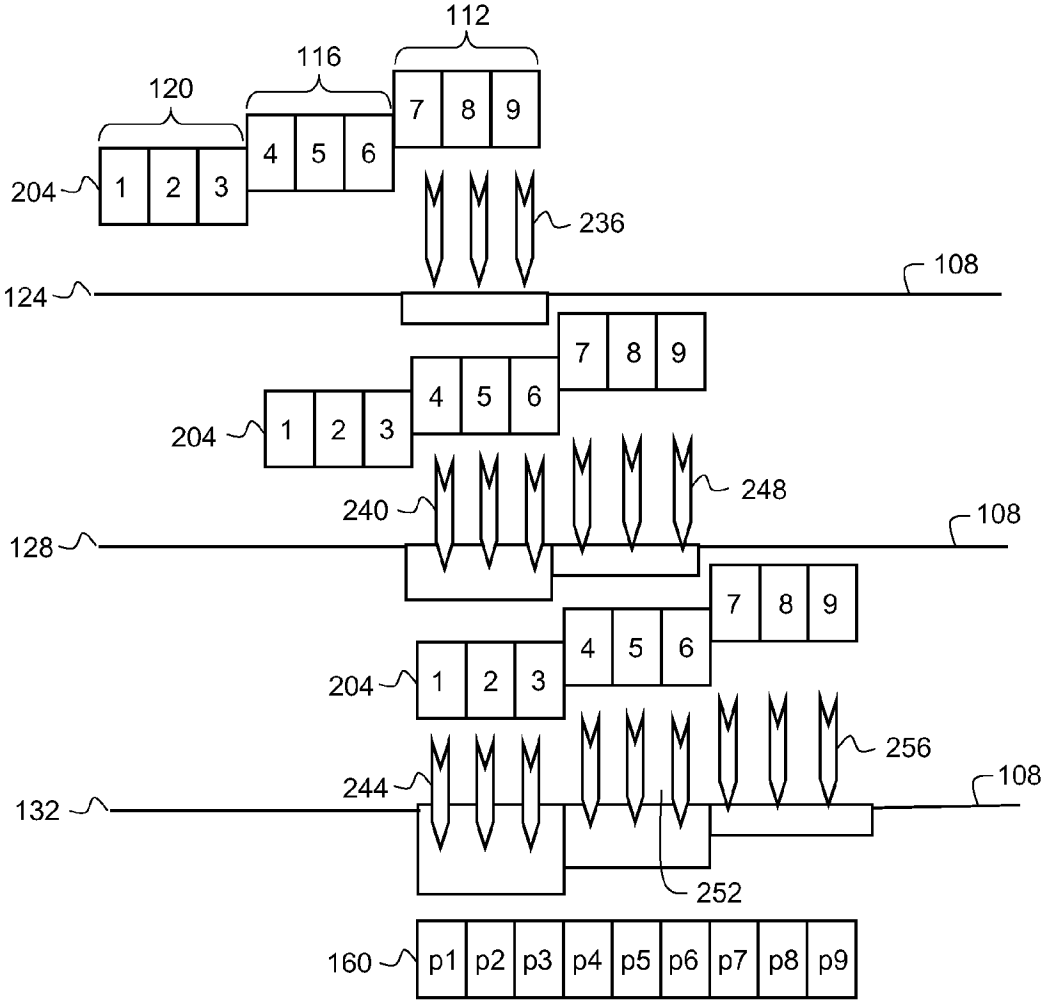
FIG. 2 is a schematic illustration of an emitter array divided into groups with each group offset with respect to other groups (stairs configuration)

In order to achieve more efficient engraving on plate surface 108, the focal plane of the emitted light applied on the same region should be substantially different for each subsequent drum revolution. FIG. 2 shows an array of emitters 204, wherein each group of emitters 112, 116, and 120 is positioned in incremental offset with respect to the other. Multiple emitter array 204, similar to multiple emitter array 104 shown in FIG. 1, is positioned parallel to plate surface 108. The suggested configuration of multiple emitter array 204 enables deeper engraving between subsequent drum revolutions during imaging. For example, first group 112 emits light 236 during first drum revolution 124 on pixels p1-p3. Subsequently, second group 116 emits light 240 in second drum revolution 128, and subsequently third group 120 emit light 244 in third drum revolution 132 on same pixels p1-p3. Each of the emitted lights 236, 240, and 244 is focused by imaging lens 408 on a deeper focal plane per subsequent drum revolution, thus yielding a deeper engraving into plate surface 108.

Similarly FIG. 2 shows that the first group of emitters 112 emits light 248 in a second drum revolution on pixels p4-p6. The second group of emitters 116 emits light 252 in a third drum revolution on pixels p4-p6, and the first group of emitters 112 emits light 256 in a third drum revolution on pixels p7-p9.

Figure 3:
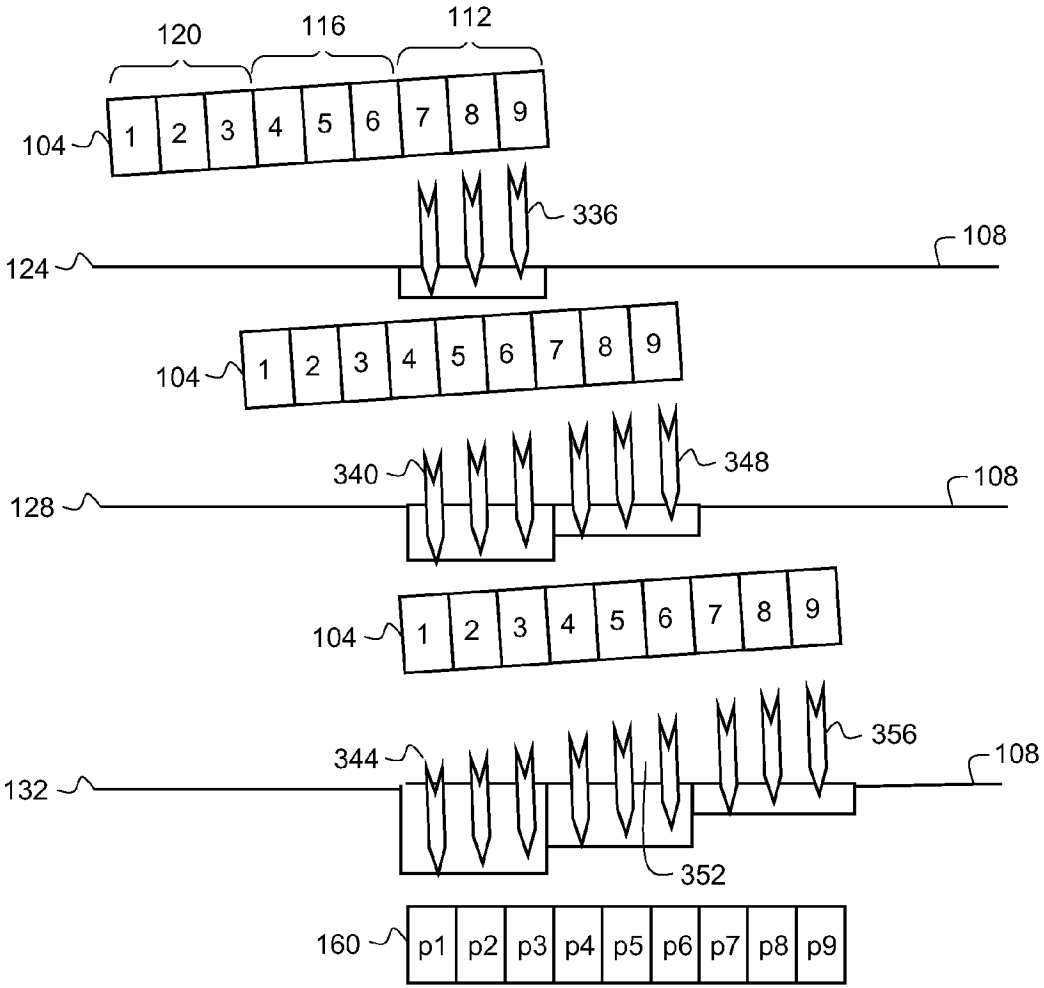
FIG. 3 is a schematic illustration of an emitter array slanted with respect to the plate imaging system.

An array 204, with multiple group of emitters offset to each other, is difficult to manufacture. FIG. 3 shows array 104 tilted at an oblique angle relative to the optical axis. Such a configuration will cause a deeper engraving between subsequent drum revolutions. For example, groups 112, 116, and 120 will emit lights 336, 340, and 344 on pixels p1-p3 during subsequent drum revolutions. Due to the tilted configuration of multiple emitter array 104 with respect to plate surface 108, each of lights 336, 340, and 344 are focused by imaging lens 408 on a deeper plane for each subsequent drum revolution, and as such will result in deeper engraving on pixels p1-p3 during imaging.

Similarly FIG. 3 shows that the first group of emitters 112 emits light 348 in a second drum revolution on pixels p4-p6. The second group of emitters 116 emits light 352 in a third drum revolution on pixels p4-p6, and the first group of emitters 112 emits light 356 in a third drum revolution on pixels p7-p9. While FIG. 2 and FIG. 3 show the concept of the patent application, FIG. 5 describes an enabling embodiment for a CTP machine based on the concept shown by FIG. 3.

Figure 5:
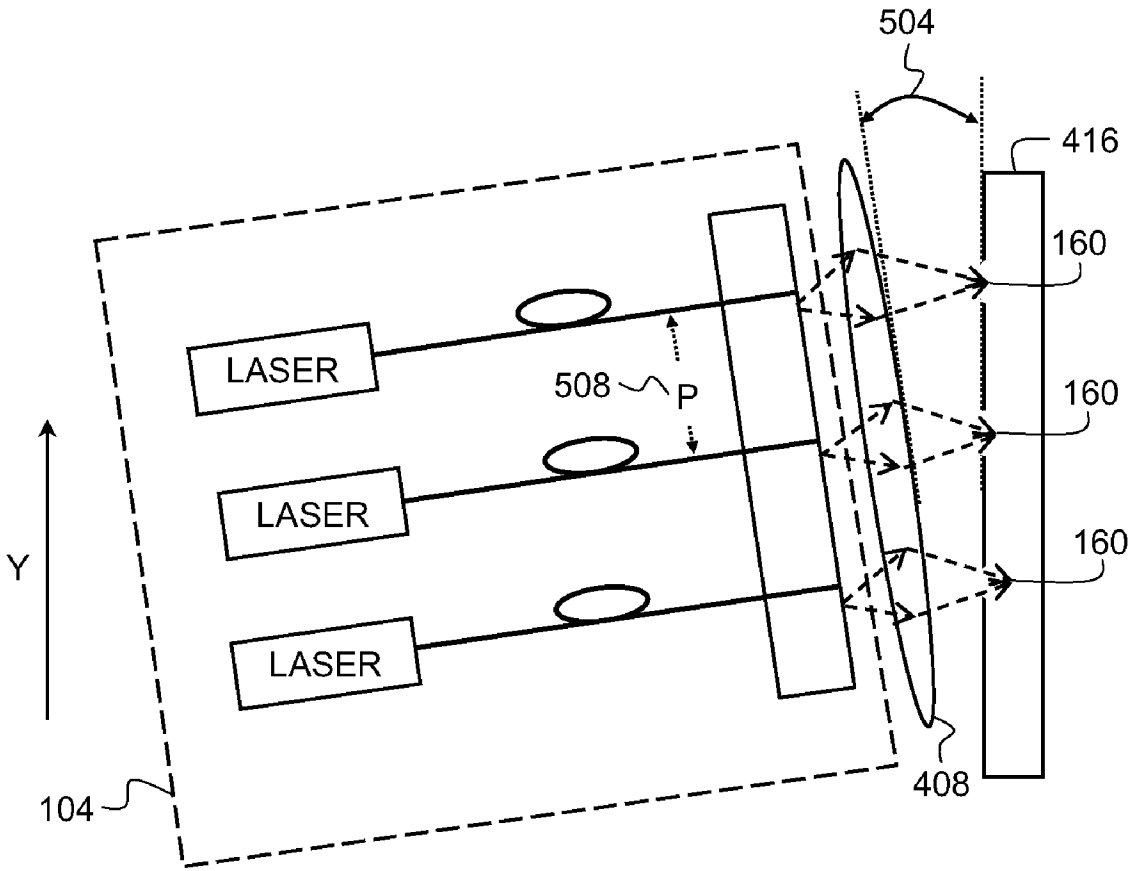
FIG. 5 is a schematic describing a preferred embodiment based on the concept of a tilted optical head configured from fiber coupled diodes.

FIG. 5 describes an optical head with array of emitters 104 configured from fiber coupled laser diodes that move in the Y direction in parallel and relative to a printing plate 416. A predefined inclination angle 504 and pitch 508 enables to focus a laser source; the distal tip of the fiber, underneath the upper surface of the printing plate 416, on a spot that was already irradiated and ablated by at least one of the previous laser sources. The optical head can be adjusted within the CTP machine at a desired inclination angle 504 and distance relative to the plate 416 by using an adequate mechanical assembly. Such a configuration improves the engraving of different types of flexographic plates.

While the invention has been described with respect to a limited number of embodiments, these should not be construed as limitations on the scope of the invention, but rather as exemplifications of some of the preferred embodiments. Other possible variations, modifications, and applications are also within the scope of the invention. For example, even though one imaging lens has been shown, multiple lenses may be used.

PARTS LIST

104 array of multiple emitters
108 plate surface (substrate)
112 first group of emitters
116 second group of emitters
120 third group of emitters
124 first drum revolution
128 second drum revolution
132 third drum revolution
136 first group of emitters emitting in first drum revolution
140 second group of emitters emitting in second drum revolution
144 third group of emitters emitting in third drum revolution
148 first group of emitters emitting in second drum revolution
152 second group of emitters emitting in third drum revolution
156 first group of emitters emitting in third drum revolution
160 pixels on plate created by multiple imaging
204 array of multiple emitters arranged in a staircase configuration
236 first group of emitters emitting in first drum revolution
240 second group of emitters emitting in second drum revolution
244 third group of emitters emitting in third drum revolution
248 first group of emitters emitting in second drum revolution
252 second group of emitters emitting in third drum revolution
256 first group of emitters emitting in third drum revolution
336 first group of emitters emitting in first drum revolution
340 second group of emitters emitting in second drum revolution
344 third group of emitters emitting in third drum revolution
348 first group of emitters emitting in second drum revolution
352 second group of emitters emitting in third drum revolution
356 first group of emitters emitting in third drum revolution
404 imaging head
408 imaging lens
412 imaging drum
416 printing plate
504 inclination angle
508 pitch

The invention claimed is:

1. An imaging head for engraving an image on a substrate comprising:

an array of emitters comprised of groups of emitters wherein focal points of all of said emitters are arranged on a line wherein said line is inclined relative to a Y direction wherein said Y direction is perpendicular to direction of drum rotation on surface of said substrate;

an imaging lens configured to focus light from each group onto said substrate wherein said imaging lens is used to focus light emitted from all of said emitters;

wherein by inclination of said line light from each group of emitters is focused at a different depth relative to a surface of said substrate; and wherein said imaging head is inclined at an angle relative to said substrate.

2. The imaging head according to claim 1 wherein said group of emitters comprise one emitter or more.

3. The imaging head according to claim 1 wherein said imaging lens is constructed from one imaging lens or plurality of imaging lenses.

4. The imaging head according to claim 1 wherein at least two of said groups of emitters are configured to image on the same region of said substrate during subsequent imaging cycles.

5. The imaging head according to claim 4 wherein said imaging cycles occur at different drum revolutions.

6. The imaging head according to claim 1 wherein said imaging lens is a telecentric lens.

7. The imaging head according to claim 1 wherein said emitters are fiber coupled.

8. The imaging head according to claim 1 wherein said emitters are fiber lasers.

9. The imaging head according to claim 1 wherein said array of multiple emitters is inclined at an angle relative to said substrate.

10. The imaging head according to claim 1 wherein each of said groups is offset with respect to an adjacent group.

* * * * *